US010037861B2

(12) United States Patent
Flechsig et al.

(10) Patent No.: US 10,037,861 B2
(45) Date of Patent: Jul. 31, 2018

(54) LAMP, METHOD FOR MANUFACTURING A LAMP AND USE OF A HOLDER FOR SUCH A LAMP

(75) Inventors: Juergen Flechsig, Plauen (DE); Peter Rosenmueller, Plauen (DE)

(73) Assignee: Lumileds LLC, San Jose, CA (US)

( * ) Notice: Subject to any disclaimer, the term of this patent is extended or adjusted under 35 U.S.C. 154(b) by 2204 days.

(21) Appl. No.: 12/594,832

(22) PCT Filed: Apr. 8, 2008

(86) PCT No.: PCT/IB2008/051328

§ 371 (c)(1),
(2), (4) Date: Oct. 6, 2009

(87) PCT Pub. No.: WO2008/126008

PCT Pub. Date: Oct. 23, 2008

(65) Prior Publication Data

US 2010/0117508 A1 May 13, 2010

(30) Foreign Application Priority Data

Apr. 13, 2007 (EP) ..... 07106139

(51) Int. Cl.
*H01J 5/60* (2006.01)
*H01K 1/58* (2006.01)
(Continued)

(52) U.S. Cl.
CPC ..... *H01J 5/60* (2013.01); *H01J 61/52* (2013.01); *H01K 1/46* (2013.01); *H01K 1/58* (2013.01)

(58) Field of Classification Search
CPC ... H01J 5/60; H01J 61/52; H01K 1/46; H01K 1/58
(Continued)

(56) References Cited

U.S. PATENT DOCUMENTS 4,868,456 A 9/1989 Sanders et al.
5,036,439 A * 7/1991 Hoffmann et al. ..... 362/459
(Continued)

FOREIGN PATENT DOCUMENTS

DE 10023428 A1 2/2001
EP 0570068 A1 11/1993
(Continued)

OTHER PUBLICATIONS

EPO as ISA, PCT/IB2008/051328 filed Apr. 8, 2008, "International Search Report and Written Opinion", dated Oct. 2, 2008, 12 pages.

*Primary Examiner* — Anh Mai
*Assistant Examiner* — Nathaniel Lee

(57) ABSTRACT

A lamp (10), which is particularly a motor vehicle headlight, comprises a burner (12) for emitting light, which is supported by a holder (16) for mechanically connecting the burner (12) with a socket (14). The holder (16) comprises a metal ring (26) surrounding the burner (12). The metal ring (26) is thermally connected to the burner (12) via a single connecting surface (40), which is in planar contact to the burner (12) over an angle of ≥350° in circumferential direction. Due to the increased heat transfer to the environment the used materials are less subjected to heat, so that the overall lifetime and the shock resistance of the lamp (10) are increased at the same time.

12 Claims, 3 Drawing Sheets

(51) Int. Cl.
*H01J 61/52* (2006.01)
*H01K 1/46* (2006.01)

(58) Field of Classification Search
USPC ..... 313/318.1
See application file for complete search history.

(56) References Cited

U.S. PATENT DOCUMENTS 5,041,955 A * 8/1991 Devir ..... F21V 15/04
362/306
5,051,658 A 9/1991 Van Pijkeren
5,229,683 A * 7/1993 Eckhardt ..... H01K 1/44
313/318.01
5,250,872 A * 10/1993 Wakimizu ..... H01J 5/60
313/25
5,684,355 A * 11/1997 Seredich ..... F21V 15/04
313/252
5,747,919 A 5/1998 Gandhi et al.
5,855,430 A * 1/1999 Coushaine ..... F21S 41/194
362/519
6,254,252 B1 * 7/2001 Coushaine ..... H01J 5/62
315/58
6,271,622 B1 * 8/2001 Coushaine ..... H01K 1/18
313/272
7,002,285 B2 * 2/2006 Mudra ..... H01J 5/54
313/318.01

FOREIGN PATENT DOCUMENTS

JP 2000501554 2/2000
JP 2000260542 A 9/2000
JP 2002324416 A 11/2002
WO 200517945 A2 2/2005
WO 2005071794 A2 8/2005

* cited by examiner

LAMP, METHOD FOR MANUFACTURING A LAMP AND USE OF A HOLDER FOR SUCH A LAMP

FIELD OF THE INVENTION

The invention relates to the field of lamps, and more specifically to a motor vehicle headlight as well as to a method for manufacturing such a lamp and the use of a holder for such a lamp.

BACKGROUND OF THE INVENTION

In DE 100 23 428 A1 a lamp for use as a motor vehicle headlight is described. This lamp comprises a burner for emitting light supported by a holder. The holder comprises three or more substantially axial arranged clamping legs for receiving the burner in a defined alignment. Each clamping leg comprises a substantial linear connecting surface by which the holder is in contact to the burner.

There is a permanent need to increase the lifetime of the lamp.

SUMMARY OF THE INVENTION

It is the object of the invention to provide a lamp with an increased lifetime and a method for manufacturing such a lamp.

The object is achieved by a lamp comprising the features of claim 1, a method comprising the features of claim 10 and a use of a holder comprising the features of claim 12. Preferred embodiments of the invention are given by the dependent claims.

The lamp according to the invention, which is particularly a motor vehicle headlight, comprises a burner for emitting light, which is supported by a holder for mechanically connecting the burner with a socket. By means of the socket a power supply can be applied to the burner and/or the lamp can be mounted into a housing. The holder comprises a metal ring, which surrounds the holder. The metal ring is thermally connected to the burner via a single connecting surface. The single connecting surface is in planar contact to the burner at an angle of ≥350° in circumferential direction. If the metal ring do not comprise a slit-like recess the single surface is particularly in planar contact to the burner at an angle of 360° in circumferential direction. This means that there is an overlap area between the burner and the metal ring, wherein the connecting surface of the metal ring abut the burner in a planar manner along nearly the whole circumference of the burner in the overlap area. Additional parts of the holder providing an additional connecting surface, like clamping legs, are omitted. Particularly the single connecting surface is in planar contact to the burner at an angle of ≥350°, particularly ≥355°, preferably 360° in circumferential direction along the whole extent of the connecting surfaces in axial direction. Protruding parts contacting the burner are omitted. This means that the metal ring of the holder may comprise a plane substantially ring shaped front face, wherein the front face points away from the socket in the assembled state.

Due to the planar contact of the single connecting surface an improved heat conductance is provided from the burner to the holder. Since the contact between the burner and the metal ring is planar several small hot spots are prevented but a large area comprising an average temperature is provided. Further the heat transfer to the environment by convection is increased due to the comparatively large area provided by the metal ring. The performance of the heat conductance inside the holder is increased since the heat absorption is increased by means of the comparatively large connecting surface of the metal ring. In addition heat radiation of the burner can be absorbed by the metal ring without disturbing the portion of the emitted light necessary for lighting a street or the like. It is even possible to support focusing the emitted light of the burner by means of the metal ring. Due to the surprisingly increased heat transfer to the environment, the risk of overheating the burner is significant reduced. Since the used materials are less subjected to heat the overall lifetime of the lamp is increased. Due to the planar contact of the single connecting surface to the burner a relative movement of the burner to the holder is prevented leading to an improved shock resistance.

Preferably the cooling of the burner is improved by the design of the holder. Typically the burner comprises a glass body for housing a light emitter, like a filament. Further the burner may comprise conductors for connecting the light emitter with an energy supply. The connectors may be designed as metal pins, which can be inserted into a corresponding recess of the socket for electrical connection with the energy supply. Preferably the glass body is arranged spaced with respect to the socket, wherein between the glass body and the socket at least one cooling opening is provided by the holder. For instance the leg portions of the holder protrude from the socket such, that between the different leg portions cooling openings are provided to permit natural convection. Due to this convection a heat transfer from the burner to the environment is significantly increased reducing the risk of overheating the burner. Further a heat accumulation between the bottom of the burner and the top of the socket is prevented. Particularly preferred the bottom of the burner is spaced to the top of the socket in side view, so that between the burner and the socket a gap is provided and ambient air can flow between the burner and the socket without meeting a barrier.

Preferably the burner comprises a metal bush, which may be partially moulded in the glass body of the burner. The metal bush is in planar contact to the holder, so that a heat transfer by heat conduction is provided from the burner to the holder via the bush. From the holder a further heat transfer is provided by convection.

In a preferred embodiment the holder comprises at least one leg, preferably three legs. The legs may be one-piece with the holder and/or protrudes from the holder. The at least one leg comprises a leg portion and a foot portion, wherein the leg portion and the foot portion are one-piece. The foot portion and the leg portion are substantially at right angle±45°. This means the leg portion and the foot portion are angled by an angle $\alpha$, which is $45° \leq \alpha \leq 135°$, particularly $60° \leq \alpha \leq 120°$, preferably $75° \leq \alpha \leq 105°$, most preferably $88° \leq \alpha \leq 92°$. Due to the significant plastic deformation between the leg portion and the foot portion the stiffness of the holder is increased leading to a reduced relative movement between the burner and the socket and thus to an improved shock-resistance of the lamp. Due to the improved shock-resistance the risk of a malfunction is reduced, particularly during the use as headlight of a motor vehicle. For instance when the motor vehicle is driven upon an uneven road, the risk of a malfunction of the lamp is reduced. This increases the lifetime of the lamp.

When the lamp according to the invention is subjected to shocks the lamp moves substantially as a whole without significant relative vibration. Due to the increased stiffness between the burner and the socket a relative movement at comparative high frequencies is prevented. Since shocks are provided normally at low frequencies the structural stability of the lamp is sufficient to compensate occurring forces without any difficulties. The absent or at least reduced relative movement between the burner and the socket especially prevents or at least reduces the risk of damage to conductors, which may be lead from the inside of the burner through the socket to a power supply. Further the risk of a malfunction of a light emitter inside the burner for instance a filament is reduced. Since the risk of damage to the lamp during use is reduced the lifetime of the lamp is increased. Moreover the angle between the leg portion and the foot portion can be provided by a simple and cost-efficient forming step preferably by cold forming. The ratio of the length of the leg portion with respect to the length of the foot portion is especially ≥1.0, preferably ≥1.5, further preferred ≥2.0 and most preferred ≥2.5.

In a preferred embodiment the holder, preferably the leg portion of the holder comprises a damping opening 27 for providing a defined damping characteristic for the holder and/or the leg. Depending on the size, shape and arrangement of the damping opening 27 a specific damping effect can be provided. Thus, it is possible to absorb resonant frequencies of the lamp and to damp short and/or hard shocks at the same time.

Preferably the holder is made of a metal sheet. The holder can be manufactured by stamping and forming and, if so, by welding and/or bonding. Thus, it is possible to produce the holder by simple and cost-efficient manufacturing steps, which renders a production in an industrial scale advantageous. Additional materials are not necessary in principle.

It is further preferred that the metal ring of the holder is made of a strip-like sheet, which is ring-formed. Especially the strip-like sheet comprises front ends, which are connected to each other. This connection is preferably provided by at least one connecting member, e.g. a formed lug, which is inserted into a corresponding recess. Due to this positive-fit connection it is not necessary to weld or bond the front ends of ring-formed strip. For example, the front ends can be formed like puzzle pieces connecting the front ends to each other.

The holder may be connected via the foot portion with the socket by welding, especially laser welding. Accordingly the holder may be connected to the burner by welding, especially laser welding. The heat occurring during the welding step can be transferred to the environment via the surface area of the holder, so that a distortion of the holder and especially of the leg can be prevented. Thus, the accuracy of the alignment of the burner with respect to the socket is increased.

Preferably the holder comprises at least one clamp spring for holding the burner. The holder and the clamp springs are one-piece, so that the whole holder can be manufactured of one metal piece, e.g. a metal sheet by stamping and forming.

The invention further relates to a method for manufacturing a lamp, which is particularly designed as previously described. First a metal sheet is provided, from which a holder sheet is stamped by a single stamping step. Particularly the holder sheet may comprise a strip-like sheet, from which at least one leg, preferably three legs, protrudes. Subsequent the holder sheet or the strip-like part of the holder sheet is formed to a ring. Subsequent a burner is inserted into the ring such, that that the ring is thermally connected to the burner via a single connecting surfaces being in planar contact to the burner at an angle of ≥350°, particularly ≥355°, preferably 360° in circumferential direction. Preferably the burner is fixed to the ring by welding, particularly laser-welding. Preferably the at least one leg, if so, is formed such, that a foot portion of the leg is angled to a leg portion of the leg by an angle $\alpha$, which is $45° \leq \alpha \leq 135°$, particularly $60° \leq \alpha \leq 120°$, preferably $75° \leq \alpha \leq 105°$, most preferred $88° \leq \alpha \leq 92°$. Subsequent the foot portion may be connected to a socket. Due to the significant plastic deformation between the leg portion and the foot portion after the forming step the stiffness of the holder is increased leading to a reduced relative movement between the burner and the socket and thus to an improved shock-resistance of the lamp.

The invention further relates to a use of a holder as previously described in a lamp, particularly motor vehicle headlight, to the purpose of increasing the heat transfer of a burner of the lamp to the environment.

The invention further relates to a use of a holder as previously described in a lamp, particularly motor vehicle headlight, to the purpose of increasing the shock-resistance of a burner of the lamp.

BRIEF DESCRIPTION OF THE DRAWINGS

These and other aspects of the invention will be apparent from and elucidated with reference to the embodiments described hereinafter. In the drawings.

DETAILED DESCRIPTION OF EMBODIMENTS

Figure 1:
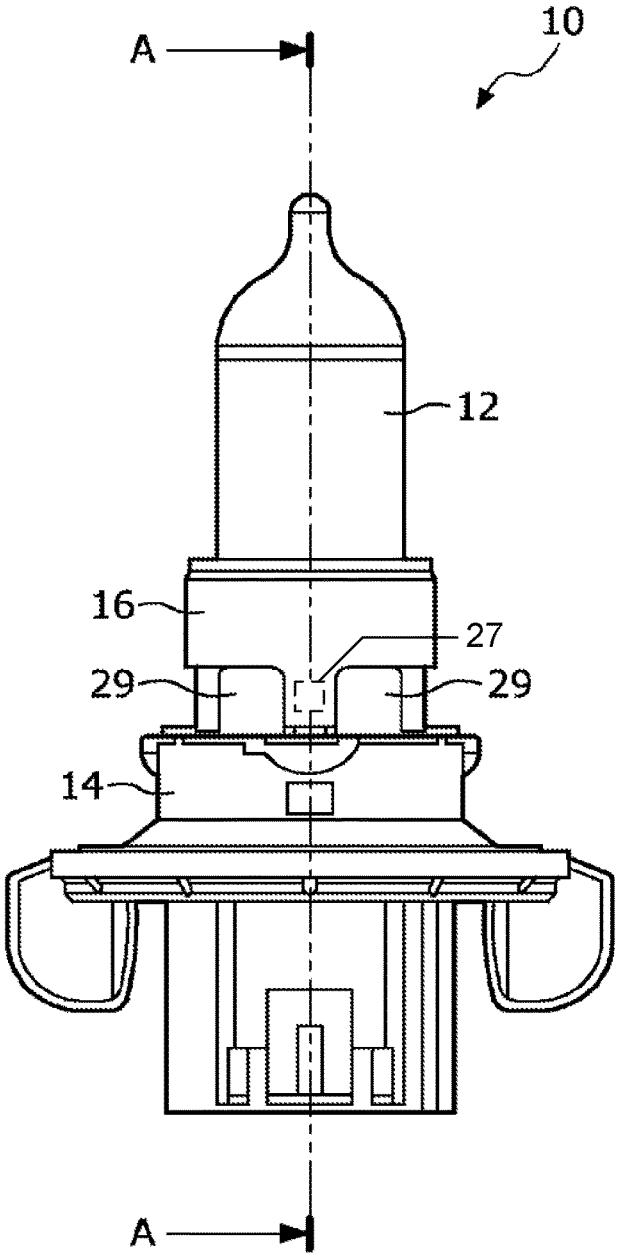
FIG. 1 is a drawn to scale side view of a lamp according to the invention and FIG. 2 is a drawn to scale sectional side view of the lamp of FIG. 1 along line A-A.
Figure 2:
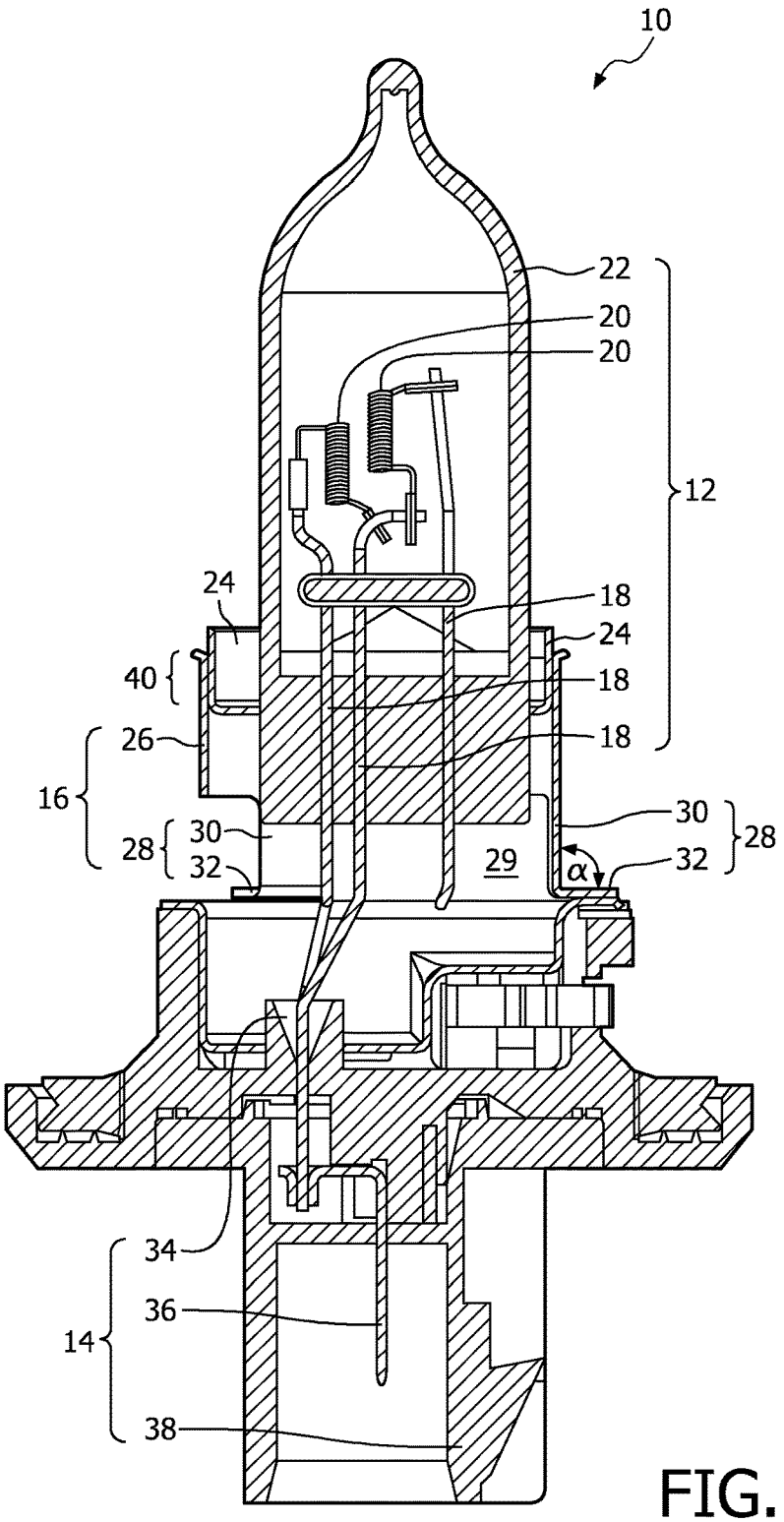
Figure 3:
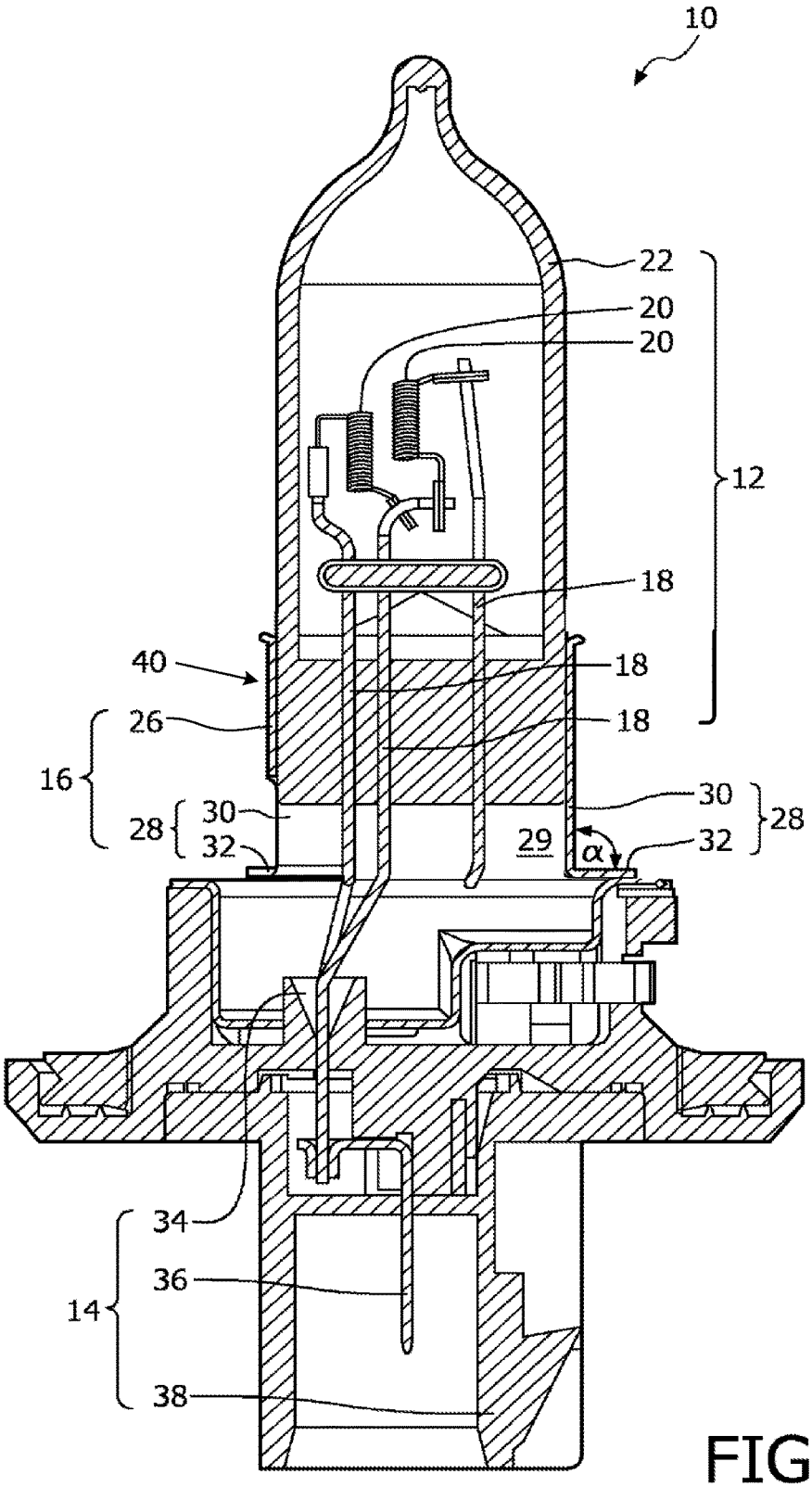
FIG. 3 is a drawn to scale sectional side view of a lamp according to one or more embodiments of the invention.

Illustrated in FIG. 1 is a lamp 10 adapted to be used as motor vehicle headlight, which comprises a burner 12 mechanically connected to a socket 14 by means of a holder 16. The burner 12 comprises three conductor pins 18 electrically connected to two filaments 20 arranged inside a glass body 22 (FIG. 2). A metal bush 24 is fixed to the glass body 22 and inserted into the holder 16.

The holder 16 comprises a metal ring 26, from which three legs 28 protrude. The metal ring 16 is in planar contact to the metal bush 24 via a connecting surface 40 of the metal ring 16 in an overlapping area between the metal ring 16 and the bush 24 improving the heat transfer from the burner 12 to the environment by thermal conduction from the bush 24 to the ring 26. Further cooling openings 29 are provided between a pair of legs 28, so that ambient air can cool the burner 12 without meeting a barrier. Each leg 28 of the holder 16 comprises a leg portion 30 and a foot portion 32, wherein the foot portion 32 is angled with respect to the substantial axial arranged leg portion 30 by an angle $\alpha$ of nearly 90°. The foot portion 32 is substantially arranged to the leg portion 30 at nearly right angle, wherein derivations of the angle $\alpha$ are still possible to provide a sufficient stiffness of the legs 28 for preventing a significant relative movement of the burner 12 with respect to the socket 14. The holder 16 is one-piece and manufactured from a metal sheet by a single stamping step and subsequent forming steps.

Each conductor pin 18 of the burner is inserted into a corresponding recess 34 and due to this alignment connected to a corresponding conductor 36 of the socket 14. The socket 14 further comprises at least one connecting means 38 for connecting the lamp 10 with a housing or the like. The conductors 36 can be connected with a power supply in the assembled state. The foot portion 32 is connected to the socket 14 by laser welding. Accordingly the metal bush 24 can be connected to the metal ring 26 by laser welding.

Since the drawings are drawn to scale specific length ratios of different elements of the invention can be derived by measuring the illustrated elements in the drawings.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the metal ring 26 and/or the bush 24 comprises in the area of the connecting surface 40 a preferably slit-like recess in axial direction providing a clamping function and a planar contact at the same time.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. Lamp comprising:

a burner (12) for emitting light, a holder (16) for mechanically connecting the burner (12) with a socket (14), the holder (16) comprising a metal ring (26) and at least one leg (28) protruding from the metal ring (26), wherein:

the holder (16) supports the burner (12), the metal ring (26) surrounds the burner (12), the metal ring (26) is thermally connected to the burner (12) via a single connecting surface (40) that is in planar contact to the burner (12) at an angle of ≥350° in circumferential direction and abuts against the burner (12), and the burner (12) comprises a glass body (22) and a metal bush (24) fixed to the glass body (22), the metal bush (24) being in planar contact to the metal ring (26) of the holder (16).

2. Lamp according to claim 1, wherein the single connecting surface (40) is in planar contact to the burner (12) at an angle of ≥350°, particularly ≥355°, preferably 360° in circumferential direction along the whole extent of the connecting surface (40) in axial direction.

3. Lamp according to claim 1, wherein the metal ring (26) of the holder (16) comprises a plane substantially ring-shaped front face pointing away from the socket.

4. Lamp according to claim 1, wherein:

the leg (28) comprises a leg portion (30) and a foot portion (32), the leg portion (30) and the foot portion (32) are one-piece and the foot portion (32) and the leg portion (30) are angled by an angle α, which is 45°≤α≤135°, particularly 60°≤α≤120°, preferably 75°≤α≤105°, most preferred 88°≤α≤92°.

5. Lamp according to claim 1, wherein the holder (16) comprises a damping opening for providing a defined damping characteristic for the holder (16).

6. Lamp according to claim 1, wherein the holder (16) is made of a metal sheet, particularly by stamping and forming.

7. Lamp according to claim 1, wherein the ring (26) is made of a ring-formed strip-like sheet, whose front ends are connected to each other by at least one connecting member inserted into a corresponding recess.

8. Lamp according to claim 1, wherein the metal bush (24) is partially molded in the glass body (22).

9. Method for manufacturing a lamp (10) comprising the steps:

providing a metal sheet, stamping a holder sheet from the metal sheet by a single stamping step, forming the holder sheet to a ring (26) and at least one leg (28) protruding from the ring (26), and inserting a burner (12) into the ring (26) such, that the ring (26) is in direct contact with and thermally connected to the burner (12) via a single connecting surface (40) that is in planar contact to the burner (12) at an angle of ≥350° in circumferential direction and abuts against the burner (12) wherein:

the burner (12) comprises a glass body (22) and a metal bush (24) fixed to the glass body (22), and inserting the burner (12) into the ring (26) comprises inserting the metal bush (24) into the ring (26), the metal bush (24) being in planar contact to the ring (26).

10. Method according to claim 9, whereby the leg (28) is formed such, that a foot portion (32) of the leg (28) is angled to a leg portion (30) of the leg (28) by an angle α, which is 45°≤α≤135°, particularly 60°≤α≤120°, preferably 75°≤α≤105°, most preferred 88°≤α≤92°.

11. Method according to claim 9, whereby the holder sheet comprises a strip-like sheet, from which the leg (28) protrudes, and the leg (28) is formed such, that a foot portion (32) of the leg (28) is angled to a leg portion (30) of the leg (28) by an angle α, which is 45°≤α≤135°, particularly 60°≤α≤120°, preferably 75°≤α≤105°, most preferred 88°≤α≤92°.

12. Method according to claim 9, further comprising partially molding the metal bush (24) in the glass body (22).

* * * * *